United States Patent [19]

Noguchi

[11] 3,946,921

[45] Mar. 30, 1976

[54] APPARATUS FOR FEEDING PACKAGING STRAP

[76] Inventor: Atushi Noguchi, Chiba, Japan

[22] Filed: Mar. 25, 1974

[21] Appl. No.: 454,554

[30] Foreign Application Priority Data

Feb. 18, 1974 Japan ..... 49-18524

[52] U.S. Cl. ..... 226/43; 226/49

[51] Int. Cl.[2] ..... B65H 25/32

[58] Field of Search ..... 226/27, 32, 33, 24, 43, 226/49–51, 9

[56] References Cited

UNITED STATES PATENTS

| | | | |
|---|---|---|---|
| 3,045,884 | 7/1962 | Buhrendorf | 226/50 |
| 3,174,610 | 3/1965 | Barbugallo | 226/9 X |
| 3,590,729 | 7/1971 | Plattner | 226/49 X |
| 3,605,465 | 9/1971 | Timmerbeil | 226/33 X |

*Primary Examiner*—Richard A. Schacher
*Attorney, Agent, or Firm*—Robert E. Burns; Emmanuel J. Lobato; Bruce L. Adams

[57] ABSTRACT

An automatic apparatus for feeding packaging strap, including a strap feeding mechanism having a pair of reversibly rotatable feed rolls for feeding and returning the strap and a detector for detecting the amount of strap fed and returned. Strap is fed to the feeding mechanism by a prefeeding mechanism having unidirectionally rotatable prefeed rolls and a detector for detecting the amount of strap prefed. A control mechanism determines the difference between the amount of strap fed and returned by the feeding mechanism and controls the prefeeding mechanism to prefeed an amount of strap equal to the difference.

5 Claims, 8 Drawing Figures

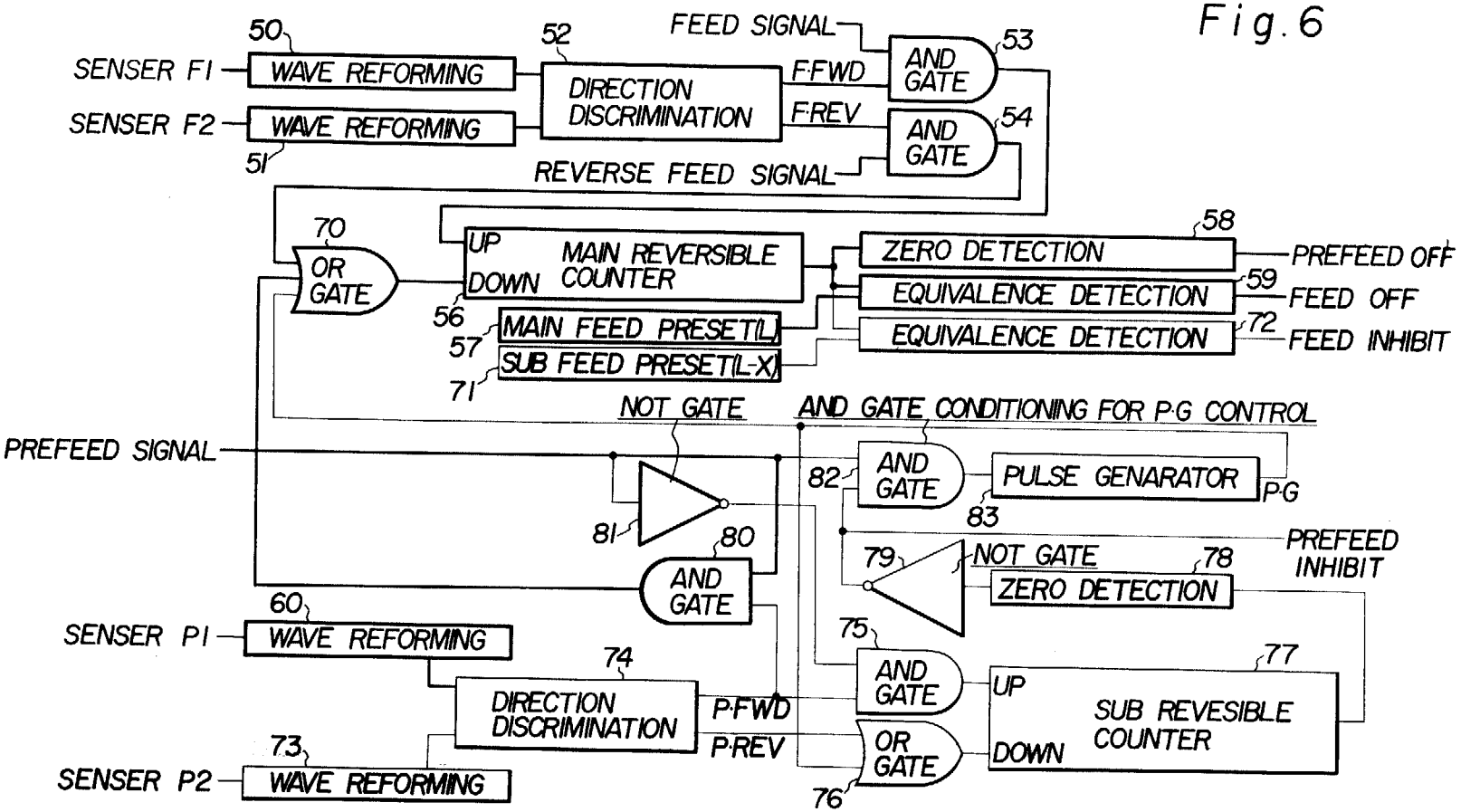
Fig. 6
SENSER F1
SENSER F2
WAVE REFORMING
WAVE REFORMING
50
51
DIRECTION DISCRIMINATION
52
FEED SIGNAL
F·FWD
F·REV
REVERSE FEED SIGNAL
AND GATE
AND GATE
53
54
OR GATE
70
UP
DOWN
MAIN REVERSIBLE COUNTER
56
MAIN FEED PRESET(L)
SUB FEED PRESET(L-X)
57
71
ZERO DETECTION
58
EQUIVALENCE DETECTION
59
EQUIVALENCE DETECTION
72
PREFEED OFF
FEED OFF
FEED INHIBIT
NOT GATE
81
AND GATE
80
PREFEED SIGNAL
AND GATE CONDITIONING FOR P·G CONTROL
AND GATE
82
PULSE GENARATOR
83
P·G
NOT GATE
79
ZERO DETECTION
78
PREFEED INHIBIT
SENSER P1
SENSER P2
WAVE REFORMING
WAVE REFORMING
60
73
DIRECTION DISCRIMINATION
74
P·FWD
P·REV
AND GATE
75
OR GATE
76
UP
DOWN
SUB REVESIBLE COUNTER
77

APPARATUS FOR FEEDING PACKAGING STRAP

BACKGROUND OF THE INVENTION

1. Field of the Invention

The present invention relates to an automatic feeding apparatus of packaging strap for use in an automatic packaging machine and more particularly to an automatic strap feeding apparatus having a control mechanism for determining the amount of strap consumed during every packing operation to control the feeding of an amount of strap prior to each packing operation equal to the amount consumed during the previous packing operation.

2. Description of the Prior Art

Prevalently used automatic packaging machines are of the type in which the arched frame for guiding the packaging strap is provided above the operation table where the package to be strapped is placed and strapping is made around the package to be strapped placed inside said arched frame.

Said arch type automatic packaging machine is characterized in that the feeding roller for feeding the packaging strap to the strap guide track inside said arch is equipped and the strap is fed to the inside of the arch by forwardly rotating said feed roller and by reversely rotating said feed roller, winding the strap around the package to be strapped and tightening are made. This type of automatic packaging machine is generally called feed out type.

Strap feeding means of feed out type in the early stage comprises a pair of forward and reverse rotation feed rolls by which the packaging strap is pulled out directly from the strap reel and rewinding is made. Therefore owing to the inertia of the strap reel, the speed of the strap feeding is decreased and the deformation of plastic strap is caused by its curve, twist or buckling. Furthermore rewinding for tightening the strap is extremely difficult. In order to overcome these disadvantages in said early means, the means generally called prefeeding type was developed.

With reference to FIG. 8 which shows a typical example of the prefeed type, it is characterized in that the strap amount detecting means comprising prefeed roller 6, strap pool 9, movable plate 35 and limit switch 34 as well as feed roller 3 is provided and when the extra loosening of the strap inside the strap pool is disappeared, the strap is always replenished by the prefeed roller regardless of the consumption amount of strap. By this the feeding speed of strap can be increased, but there was caused the new disadvantage that the strap amount accommodated inside the strap pool is not maintained constant and since operation is carried out so that the strap is always supplied to the inside of the pool, the curving tendency of packaging strap made of plastic material is caused when the packaging machine is not in operation.

SUMMARY OF THE INVENTION

An object of the present invention is to provide a strap feeding apparatus in which the curving tendency is not caused on the strap accommodated inside the strap pool and the strap is not damaged.

Another object of the present invention is to provide a strap feeding apparatus in which the error caused in feeding of the strap can be removed smoothly and surely.

In order to achieve these objects, the present invention provides the strap feeding apparatus which every packaging cycle supplies the corresponding strap amount to that of the strap consumption based on the calculation by an electronic device. Also provided is the strap feeding apparatus having the means which calculates the proper feeding amount by subtracting the error amount occurred in feeding of strap from the feeding amount at the next time of feeding.

The present invention is described in its details with reference to the embodiment shown in the figures.

The packaging strap or tape is generally made of the raw materials of thermo plasticity plastic materials such as polyethylene, polypropylene and others, but it goes without saying that the materials can be selected freely depending upon the application purposes of the packaging machine. Therefore, the present invention cannot be restricted by the types of raw materials.

These and other objects, features and advantages of the strap feeding apparatus for an automatic packaging machine according to the present invention will become more fully apparent from the following description taken in conjunction with the accompanying drawings.

BRIEF DESCRIPTION OF DRAWINGS

FIG. 6 is a logic circuit diagram of the calculation control of the strap feeding apparatus of error correction type;

DETAILED DESCRIPTION OF PREFERRED EMBODIMENTS

Figure 1:
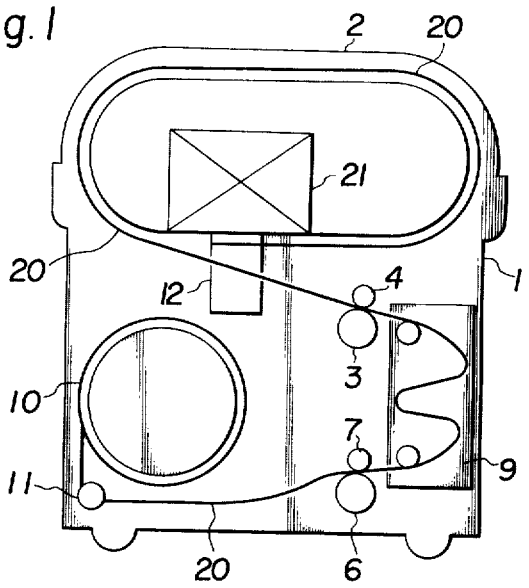
FIG. 1 is a schematic view of the entire packaging machine.

Prefeed type packaging machine is briefly described based on FIG. 1. Reference numeral 1 is a packaging machine body, and 2 is an arched frame provided above the operation table which the strap guide track is equipped inside. The remaining components are designated as follows: 3 is feed roller, 4 floating roller contacting with feed roller 3, 6 prefeed roller, 7 floating roller contacting with prefeed roller 6 and 9 is strap pool installed between feed roller 3 and prefeed roller 6. The general function of said packaging machine 1 is briefly described. The strap 20 is led to feed rollers 3, 4 from strap reel 10 through guide roller 11, prefeed rollers 6, 7, and strap pool 9, and then, by driving of feed roller 3, the strap 20 is fed to the inside of the strap track inside arched frame through strap junction device 12 until the leading edge of strap reaches the predetermined position of junction device 12.

When strap 20 is pulled back into pool 9 by reversely rotating feed roller 3 by the proper starting command generated when package 21 to be strapped is placed in the correct position on the operation table, strap 20, the leading edge of which is secured to junction device 12, is released from arched frame 2 and is wound tightly around the package 21 to be strapped. Then the overlapped portion of strap is joined by the proper method such as heat joining and the strap's portion leading to strap pool 9 is cut. Thus the strapping operation is completed.

Then, for the next strapping operation the proper amount of strap is supplied to strap pool 9 by driving of prefeed roller 6. The strap feeding apparatus according to the present invention in which the feeding amount is calculated by electronic means is described below with reference to the schematic diagram of FIG. 2 picking up only the necessary mechanisms, the logic circuit diagram of calculation control FIG. 3 and the timing diagram FIG. 4.

Figure 2:
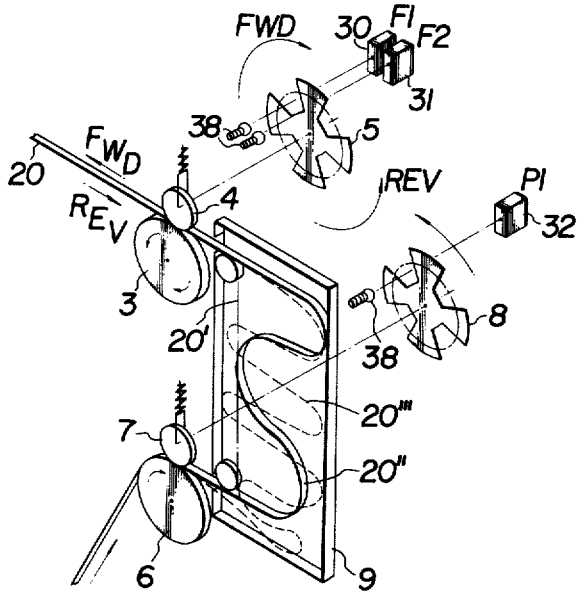
FIG. 2 is a perspective schematic view of the strap feeding machine constructed according to the present invention.
Figure 3:
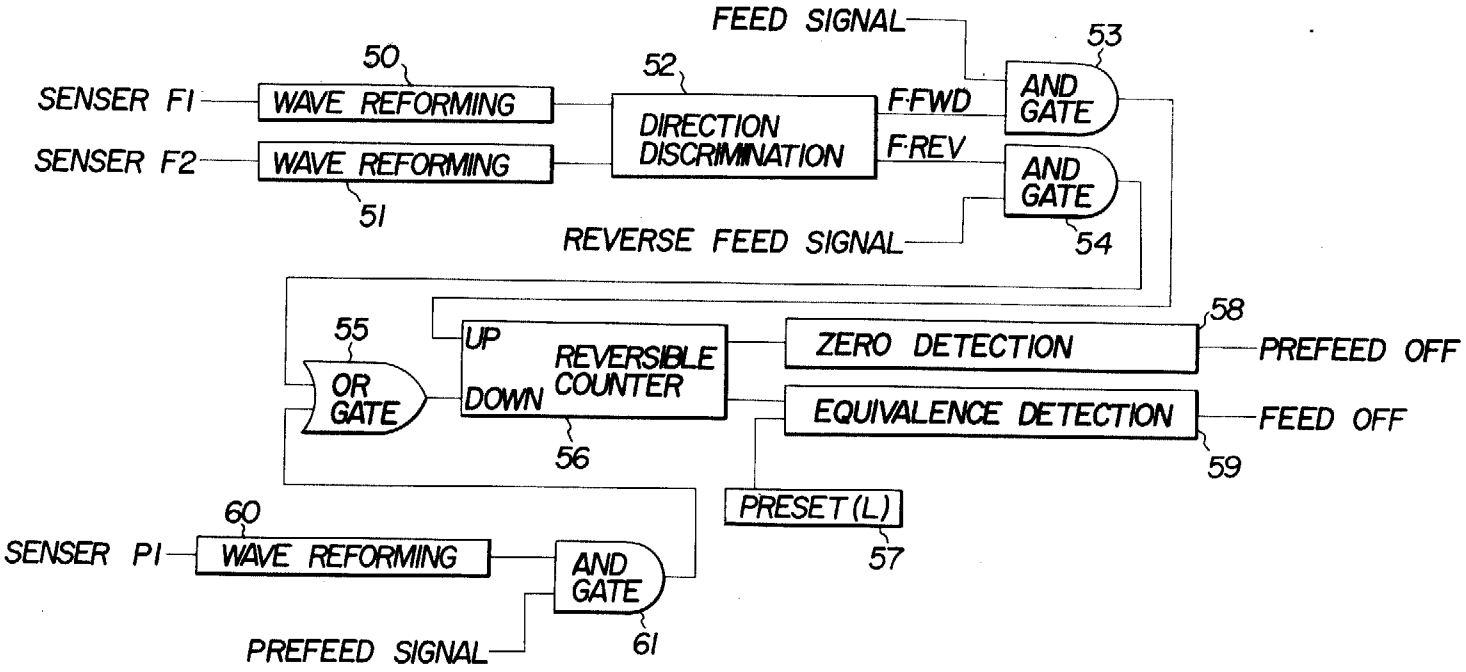
FIG. 3 is a logic circuit diagram of a calculation control of the strap feeding apparatus shown in FIG. 2.

Pulse generating plate 5 of windmill shape having a plurality of blades or shutters is linked to feed floating roller 4 which is in contact with feed roller 3 being driven by a connected electric motor and other elements (not shown), and both of them rotate together. On the periphery of said pulse generating plate 5, a proper number of hole or slit or cuts shown in FIG. 2 is formed with the constant interval. Pulse generators 30 and 31 comprising photoelectric elements and others produce pulses having constant relationships as pulse generating plate 5 is rotated to interrupt light from the light 38. This kind of pulse generating means employing a photoelectric system is previously known and is conventionally used in the present invention. The magnetic means other than photoelectric system can be used to achieve the same expected object.

Two units of pulse generators 30, 31 are disposed in the proper interval and the rotating direction of feed foller 3 is detected by the phase difference of pulses generated therefrom.

A pulse generating plate 8 and pulse generator 32, the same as previously mentioned, are also provided to prefeed floating roller 7 in contact with prefeed roller 6 and being driven by an electric motor and others. Since prefeed roller 6 is rotated in only one direction, as opposed to feed roller 3, only one pulse generator is adequate.

Output signals $F_1$, $F_2$ from pulser 30, 31 are transmitted to direction identification circuit 52 through pulse wave shaper circuit 50, 51 and the rotating direction of feed roller 3 is detected by direction identification circuit 52, and feed forward signal (F. FWD) or feed reverse signal (F. REV.) are transmitted as pulse signals.

Firstly the strap 20 is fed into the inside of arch 2 by rotating forwardly the feed roller 3.

The feeding amount (L) is the constant one determined in accordance with the length of strap path. The length L is preset in preset register 57. Reversible counter 56 is counted up as feed roller 3 is rotated and the coincidence between the control counter 56 and the contents by preset register 57 is detected by detector 59 and the termination signal is transmitted. At that time the strap feeding amount L is counted in counter 56.

Then, by rotating reversely the feed roller 3 the strap 20 is pulled back and is wound tightly around the package to be strapped 21. Reversible counter 56 is counted down as feed roller 3 is reversely rotated. The termination of pulling up of the strap is detected by detecting at the proper control circuit the changes such as the cessation of generation of pulses due to stopage of the floating roller 4 and subsequent cessation of pulse generating plate 5 as the strap is stopped against the driving force of feed roller 3 when the strap is wound around the package 21 to be strapped or by widened pulse intervals caused by speed decrease just before cessation. Then the motive power reversely rotating feed roller 3 is cut off.

The amount counted down in counter 56 equals to the amount R of strap returned and at this time L - R is counted in counter 56. This equals to the consumed amount U.

In other words, the below relationship is established $$U = L - R$$

The amount equal to R is now accommodated in strap pool 9.

When the pulling back of strap is terminated, and the starting command is applied to junction device 12, the strap is jointly stuck and cut and prefeed roller 6 is started. By rotating the prefeed roller 6, strap 20 is pulled out from reel 10 and fed to pool 9. Consequently the pulse signal $P_1$ from pulse generator 32 is transmitted into reversible counter 56 through wave shaper 60 and gate 61 and the reversible counter counts down. Then, zeroing of counter is detected by zero detection circuit 58 and prefeeding is terminated. After completion of prefeeding, the amount counted down by counter 56 equal to the strap consumption amount U with the result that the amount of strap corresponding to U has been supplied into the pool 9. At this time the amount of strap corresponding to the feeding amount L is reserved inside pool 9 for the next strapping operation. Prefeeding, however, can be made at relatively slow speed and is allowed to be completed until the next feeding operation commences.

Figure 4:
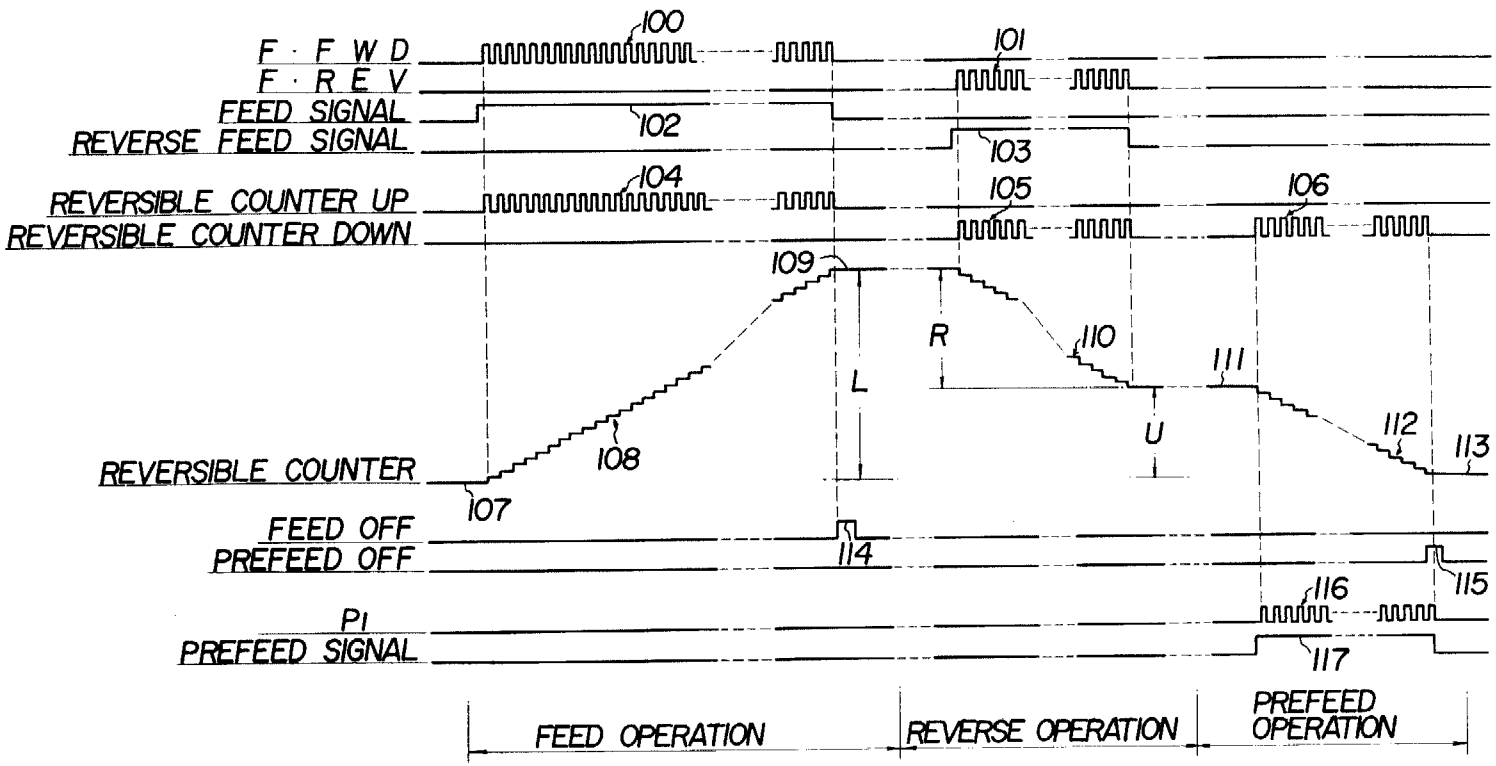
FIG. 4 is a timing diagram of the logic circuit diagram shown in FIG. 3.

The operation of each logic circuit during feeding, reversing and prefeeding previously explained would be move clearly understood referring to the timing chart shown in FIG. 4.

In the previous description, the prefeeding amount was calculated by substracting the returning amount R and consumtion amount U from the feeding amount L using the reversible counter, but supply amount U can be calculated by adding the prefeeding amount to the returning amount R using only the adding counter until the feeding amount L is obtained.

The strap feeding operation previously described shows a basic strap feeding control means provided when the mechanism such as the feed roller or prefeed roller is operated without error perfectly in accordance with the control circuits, but practically the errors caused by the inertia or the slipping of strap are inevitable and the correction of these errors are essentially necessitated.

There are two methods for error correction. First method is that the extra amount of strap is preparatively reserved inside the strap pool and prefeeding being made in a slightly smaller amount than consumption amount U, the initially reserved amount is remained by increasing the prefeeding amount when the gradually decreasing amount of strap reaches a certain amount. Second method is that prefeeding is made in slightly bigger amount than the consumption amount and this excessive amount is substructed from next supply amount.

Figure 5:
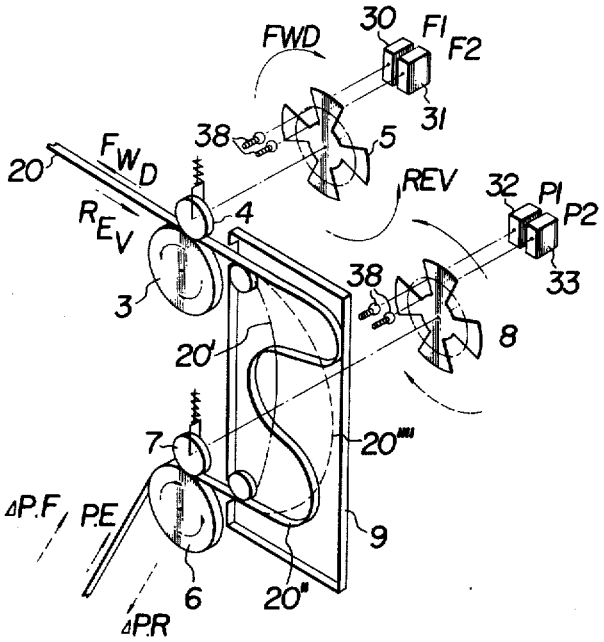
FIG. 5 is a perspective schematic view of the strap feeding apparatus of error correction type.
Figure 8:
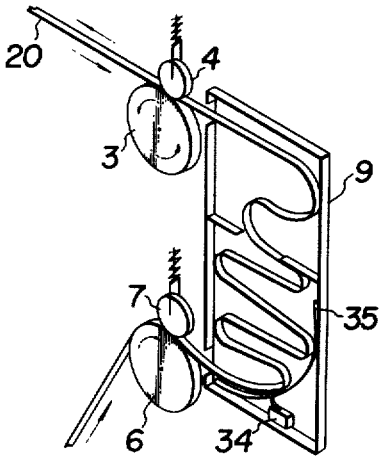
FIG. 8 is a perspective schematic view of the conventional strap feeding apparatus of prefeed type.

There are various disadvantages when the former method is employed. It is troublesome that a certain amount of extra strap has to be preparatively set before starting of the said strapping machine as well as the feeding amount L into the strap pool, and when the limitation of decrease of extra amount is misdetected, the feeding amount becomes short or cutting of the strap may be caused, bringing about the problem of fail safe operation. Furthermore, making the prefeeding amount slightly less than the consumed amount opposes the intrinsic tendency of the mechanism that the prefeeding amouht is more than the specified value due to the inertia or delay of response of prefeed roller and unreasonableness will be caused functionally. On the contrary, the latter error correction method accepts the natural tendency of the mechanism and further the error is corrected precisely. Therefore the latter is employed in the present invention. That will be described based on FIG. 5 to FIG. 7.

the constructional FIG. 5 is exactly the same as that of FIG. 2 except that a new pulse generator 33 for detecting the rotating direction of prefeed roller 6 is added, and therefore identical numbers are given to corresponding parts. Also there are corresponding parts in the logic circuit diagram of FIG. 6 with those in FIG. 3. Therefore those portions are drawn in thick line and common numbers are given. The control circuit of the error correction type strap feeding apparatus is characterized in that direction identification circuit 74 for identifying the rotating direction of prefeed roller 6, supplemental reversible counter 77 for counting the feeding error amount and pulse generator circuit 83 having the special function described later are newly provided.

Figure 7:
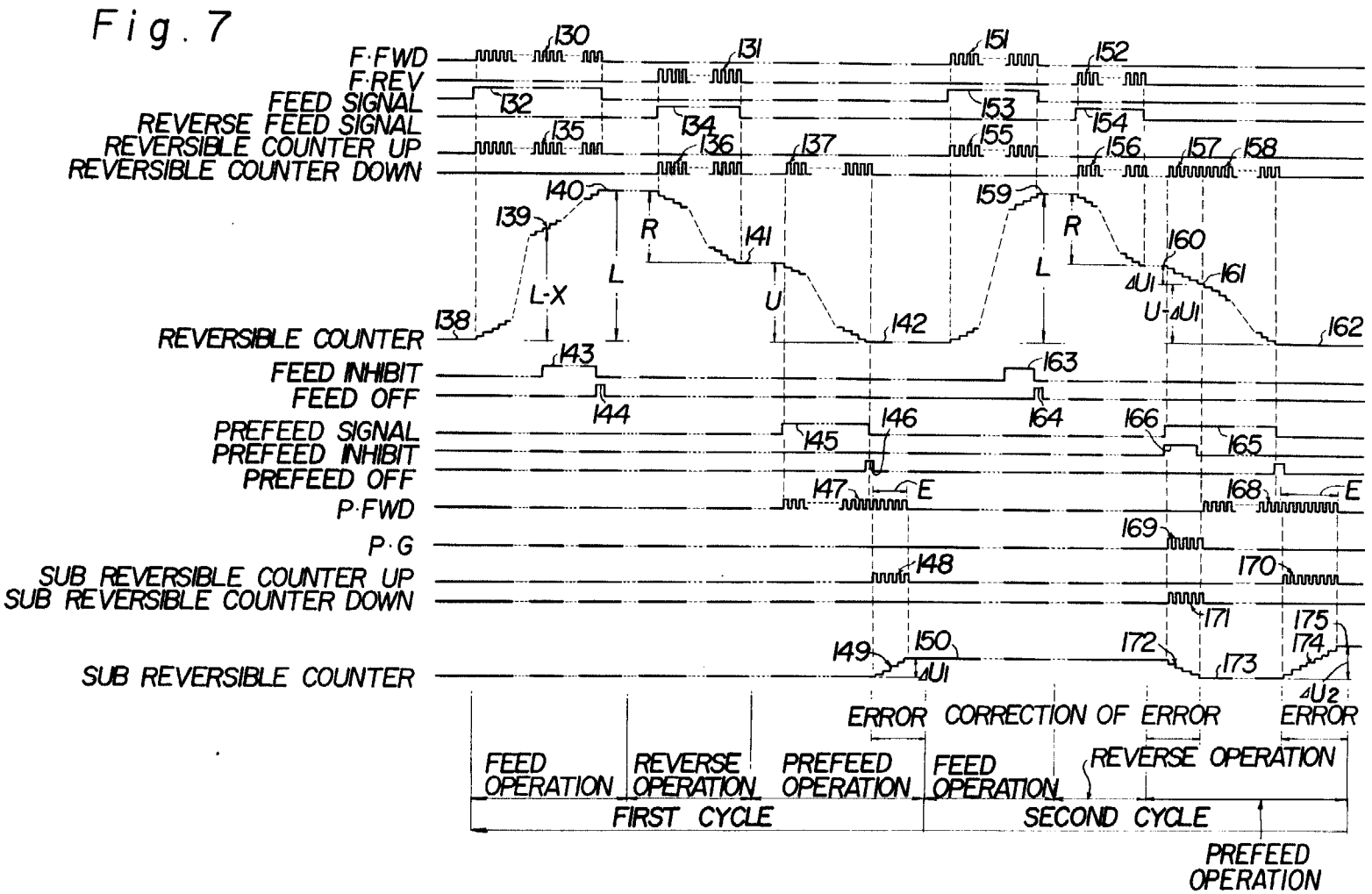
FIG. 7 is a timing diagram of the logic circuit shown in FIG. 6.

The function of control circuit of FIG. 6 will be described sequentially. In the first strapping cycle, feeding amount L is counted by main counter 56, returning amount R is substracted from it and prefeeding amount U is substracted. This procedure is the same as that in the control circuit of the previously described FIG. 3. When strap consumption amount U is fed to strap pool, however, practically the extra amount $\Delta U_1$ is fed as error due to the inertia and others of prefeed roller 6 even after a prefeed off signal is generated. The said error amount $\Delta U_1$ is counted by supplemental counter 77 through AND gate 75. Pulses in the E section of P. FWD signal in the timing chart of FIG. 7 is are those generated when error amount $\Delta U$ is fed. Therefore at the time when first strap supply is terminated, the amount of strap equal to returning amount R + consumption amount U + error amount $\Delta U_1$, namely, feeding amount L + error amount $\Delta U_1$ is accommodated in strap pool.

When the second strapping cycle commences, the strap feeding and returning operation is carried out identically to the previous one, but in the process of consumption amount supply the driving of prefeed roller 6 is temporarily inhibited even if prefeed signal is transmitted, and during that time pulse generator circuit 83 is operated and main counter 56 through OR gate 70 and supplemental counter 77 through OR gate 76 are counted down until supplemental counter 77 is zeroed. This means that the error amount $\Delta U_1$ in the previous cycle is substracted from main counter 56. Then, by driving of prefeed roller 6 the strap is fed to the pool until main counter 56 is zeroed. Thus the supplying amount of that time is $U - \Delta U_1$ and error amount $\Delta U_1$ in the previous cycle is removed. In second supply of strap, the error amount $\Delta U_2$ is caused, but is also eliminated in next supply. In this manner, the amount which the supply error amount caused in the previous cycle is substracted every cycle is supplied.

At the time of termination of prefeeding, a small amount of strap may be pulled back to the side of strap reel due to the reaction of tension of strap. This returned amount is detected by reverse rotation of prefeed floating roller 7 and is dealt by substracting from the contents of the supplemental counter 77 through OR gate 76 pulses generated at that time. Register 71 in the circuit diagram of FIG. 6 is the supplemental feed preset registor in which numerical valve L − X slightly less than feeding amount L is preset and at which the leading edge of strap the reaches before the terminal point of the strap path, when driving of feed roller 3 is stopped. Then, the strap is fed by its inertia and strap feeding is terminated by operating the brake or other means when the strap feed amount becomes L.

The aforementioned function of each circuit would be more clearly understood by referring to the timing chart of FIG. 7.

In the case of the secondary tightening in which the strap wound around the package 21 to be strapped is retightened, although description is not made in the circuit diagram, it can be extremely easily embodied under the same thought as previously described. The small amount of strap returned to strap pool 9 by the said secondary tightening is counted by supplemental counter 77 and the next supply amount of strap is decreased by this amount.

In the aforementioned description, the means removing the error amount of strap supply every cycle is shown, but in other methods it is possible to accumulate the error amount, and when the accumulated value reaches a certain upper limitation, prefeeding amount is decreased and the error accumulated sofar is removed at one time. Furthermore, in the previous description the case where the next feeding process is started after completion of strap prefeeding process is shown, but completion of prefeeding can be adequately made until the next feeding is done, and this can be easily made possible by making some modifications to the control logic circuits of FIG. 3 and FIG. 6. Thus, prefeeding speed can be made much lower in comparison with feeding speed.

As described above, in the strapping machine according to the present invention, the strap feeding into guide frame 2 can be made smoothly without causing a decrease of speed and further the more firm strap supply is made as strap supply can be made at retatively low speed in comparison with strap feeding.

Since the error caused in strap supply is taken to the excessive side and is arranged to be removed at a proper time, the excessive movement due to the inertia inevitably caused in rotary mechanism can be absorbed without difficulty and the driving control of machine system can be done extremely easily.

Furthermore, since the said strapping machine is ceased with the status that strap is fed into guide frame, during the cessation the maximum loosening of only error amount $\Delta U$ is caused to the strap remained inside the strap pool and the curving tendency on the strap is not brought about at all.

Furthermore, since the movement amount of strap is calculated through the conversion to electric signal by the rotations of floating roller 4, 7 and pulse generating devices 5, 8, 30, 33, feeding amount L, returning amount R, consumption amount U and error amount $\Delta U$ can be calculated firmly and accurately regardless of softness and properties of strap. In addition, by employing the electronic control means, the various effects can be expected such as firm performance of control function, high reliability, simplification of whole strapping machine and extreme economy because of easy maintenance and adjustment.

What is claimed is:

1. An automatic feeding apparatus for feeding packaging strap or the like, comprising:

a strap feeding mechanism having means for detecting an amount of strap fed by the mechanism, and reversibly rotatable feed rolls for feeding the strap;

a strap prefeeding mechanism for prefeeding strap to said strap feeding mechanism and having means for detecting an amount of strap prefed, and unidirectionally rotatable prefeed rolls for prefeeding said strap;

and a control mechanism having means for determining the amount (L) of strap fed when said feed rolls are rotated in a normal direction, means for determining the amount (R) of strap returned when said feed rolls are reversely rotated, means for determining the amount of strap prefed when said prefeed rolls are rotated, and means for stopping the strap prefeed rolls when the amount of strap prefed becomes equal to the difference between the amount (R) of strap returned and the amount (L) of strap fed.

2. An automatic feeding apparatus for feeding packaging strap, as set forth in claim 1, wherein the means for detecting the amount of strap fed in said strap feeding mechanism and the means for detecting an amount of strap prefed in said strap prefeeding mechanism each comprise means for generating pulses in pulse trains correlated to the amount of strap fed or prefed, respectively.

3. An automatic feeding apparatus of packaging strap as set forth in claim 1, wherein the means for detecting the amount of strap fed in said strap feeding mechanism and the means for detecting an amount of strap prefed in said strap prefeeding mechanism each comprise means for generating pulses in pulse trains correlated to the amount of strap fed or prefed, respectively;

and said control mechanism comprises a reversible counter for counting said pulses to determine the amount (L) of strap fed, the amount (R) of strap returned and the amount of strap supplied by counting up when the feed rolls are normally rotated and counting down when the feed rolls are reversely rotated and the prefeed rolls are rotated, an equivalent amount detecting circuit for detecting when the value corresponding to the amount (L) of strap fed is applied to said reversible counter to develop a strap feed ending signal, and a zero equivalent value detecting circuit for detecting a zero count in said reversible counter to develop a prefeed ending signal.

4. An automatic feeding apparatus for feeding packaging strap as set forth in claim 1, further comprising means for memorizing a count of pulses representative of an error amount of the strap prefed to said feeding mechanism;

and means operable for subtracting the error amount from the next successive strap supplying amount, whereby the error can be corrected.

5. An automatic feeding apparatus for feeding packaging strap as set forth in claim 4, further comprising a pulse generating circiut for generating a pulse to enable said means operable for subtracting the error amount from the next successive strap supplying amount prior to the prefeeding operation only when error is generated in the previous prefeeding operation to count down the reversible counter;

a second reversible counter for counting and memorizing the error amount and rendered operative to count down by the pulse output from the pulse generating circuit;

and a zero equivalent value detecting circuit for disabling said pulse generating circuit by detecting when the count stored in said second reversible counter becomes zero.

* * * * *